US007412826B2

(12) United States Patent
Horii

(10) Patent No.: US 7,412,826 B2
(45) Date of Patent: Aug. 19, 2008

(54) HYDRAULIC SYSTEM FOR WORK VEHICLE

(75) Inventor: Hiroshi Horii, Sakai (JP)

(73) Assignee: Kubota Corporation, Osaka (JP)

( * ) Notice: Subject to any disclaimer, the term of this patent is extended or adjusted under 35 U.S.C. 154(b) by 142 days.

(21) Appl. No.: 11/397,953

(22) Filed: Apr. 4, 2006

(65) Prior Publication Data

US 2006/0242958 A1 Nov. 2, 2006

(30) Foreign Application Priority Data

Apr. 21, 2005 (JP) ..... 2005-123887

(51) Int. Cl.
*F16D 31/02* (2006.01)

(52) U.S. Cl. ..... 60/421; 60/429

(58) Field of Classification Search ..... 60/421, 60/428, 429, 468
See application file for complete search history.

(56) References Cited

U.S. PATENT DOCUMENTS 4,508,281 A * 4/1985 Plater ..... 254/274
6,619,037 B1 * 9/2003 Toyooka et al. ..... 60/421
2004/0123499 A1 7/2004 Arii

FOREIGN PATENT DOCUMENTS

| | | |
|---|---|---|
| EP | 1 178 157 A | 2/2002 |
| EP | 1 191 233 A | 3/2002 |
| JP | H11-36378 A | 7/1997 |

* cited by examiner

*Primary Examiner*—Michael Leslie
(74) *Attorney, Agent, or Firm*—The Webb Law Firm

(57) ABSTRACT

The hydraulic system for a work vehicle includes a main hydraulic pump, a main supply circuit through which pressurized oil from the main hydraulic pump flows, a sub hydraulic pump, and a sub supply circuit through which pressurized oil from the sub hydraulic pump flows. The main supply circuit supplies pressurized oil to a hydraulic travel motor that drives a travel device and a service actuator that is disposed in an attachment with which the work vehicle is detachably furnished. The sub supply circuit merges with the main supply circuit and supplies pressurized oil to the service actuator. The hydraulic system for a work vehicle further includes a flow amount adjustment valve that adjusts the flow amount of the pressurized oil from the sub supply circuit that merges with the main supply circuit.

3 Claims, 8 Drawing Sheets

HYDRAULIC SYSTEM FOR WORK VEHICLE

BACKGROUND OF THE INVENTION

The present invention relates to hydraulic systems for work vehicles such as backhoes.

Conventionally, work vehicles such as backhoes are furnished with a pair of left and right hydraulic travel motors, a plurality of hydraulic cylinders, and service ports that can supply pressurized oil to the actuator (service actuator) for externally detachable attachments, and also are furnished with a hydraulic system that can simultaneously operate these hydraulic actuators. The hydraulic system includes a tank for storing pressurized oil, a main hydraulic pump and a sub hydraulic pump that can be driven by the engine, and a plurality of supply circuits that connect the hydraulic devices, hydraulic pumps, and the tank. The supply circuits are switched in accordance with the working conditions in order to supply a suitable amount of pressurized oil to each hydraulic actuator.

In one such common hydraulic system, if the travel motors are not to be driven, then the pressurized oil from the main hydraulic pump is supplied to the other hydraulic actuators excluding the travel motors, and if the travel motors are to be driven, then the pressurized oil from the main hydraulic pump is supplied only to the travel motors and the sub hydraulic pump supplies pressurized to the other hydraulic actuators.

In recent years, however, attachments that are attached and detached from the outside and furnished with service actuators that require more pressurized oil than in the past have been developed, and along with this there have been proposals for a hydraulic system that allows the pressurized oil from the sub hydraulic pump to be combined with the pressurized oil that is supplied by the main hydraulic pump to the service actuators during times when the travel motors are not driven.

There have been proposals for such a hydraulic system in which it is possible to select whether or not to combine the pressurized oil from the sub hydraulic pump in accord with the amount of oil that is required to drive the service actuator of the attachment that has been attached to the work vehicle.

For example, JP H11-36378A proposes a hydraulic system for a work vehicle that is provided with a switching means for switching between combining and not combining the pressurized oil from the sub hydraulic pump with the pressurized oil that is supplied to the service actuator by the main hydraulic pump, and the switching means is provided with a switch valve for switching, under pilot pressure, between combining the pressurized oil from the sub hydraulic pump with the pressurized oil from the main hydraulic pump and draining the pressurized oil of the sub hydraulic pump into the tank, and a stopcock that connects and disconnects a pilot control circuit for supplying the pilot pressure to the switch valve.

With the above hydraulic system, however, the switching means switches between combining and not combining the pressurized oil that is supplied by the sub hydraulic pump with the pressurized oil that is supplied by the main hydraulic pump to the service actuator in order to adjust the amount of pressurized oil that is supplied to the service actuator. For this reason, it was difficult to adjust the pressurized oil amount to an ideal amount for any one of various types of attachments, and this led to cases where various types of attachments could not be operated appropriately.

Further, with the above hydraulic system, the pilot control state of the switch valve is switched by opening and closing the stopcock, and through pilot actuation of the switch valve in the pilot control state, the switch valve is switched between a state of merging pressurized oil from the sub hydraulic pump with the pressurized oil from the main hydraulic pump and a state of draining the pressurized oil of the sub hydraulic pump into the tank. Thus, not only was it not possible to switch between the state of merging pressurized oil from the sub hydraulic pump with the pressurized oil from the main hydraulic pump or the state of draining it into the tank by opening and closing the stopcock alone, but the structure of the device was needlessly complicated as well, and this led to problems such as a larger valve unit and an increase in cost.

SUMMARY OF THE INVENTION

The present invention was arrived at in light of the foregoing matters. It is an: object of the invention to provide a hydraulic system for work vehicles that is simple in structure and that allows various types of attachments to be operated properly.

A first characteristic aspect of the invention is a hydraulic system for a work vehicle that includes a main hydraulic pump, a main supply circuit through which pressurized oil from the main hydraulic pump flows, a sub hydraulic pump, and a sub supply circuit through which pressurized oil from the sub hydraulic pump flows, wherein the main supply circuit supplies pressurized oil to a hydraulic travel motor that drives a travel device and a service actuator that is disposed in an attachment with which the work vehicle is detachably provided, the sub supply circuit merges with the main supply circuit and supplies pressurized oil to the service actuator, and the hydraulic system for a work vehicle further comprises a flow amount adjustment valve that adjusts the flow amount of the pressurized oil from the sub supply circuit that merges with the main supply circuit.

According to this aspect, the amount of pressurized oil that is supplied to the service actuator can be adjusted by adjusting the amount of pressurized oil from the sub supply circuit that merges with the main supply circuit. Thus, the flow amount of pressurized oil can be appropriately set for the attachment with which the work vehicle is provided. Consequently, it is possible to provide a hydraulic system for a work vehicle that allows many types of attachments to be properly operated.

A second characteristic aspect of the invention is that the flow amount adjustment valve is provided in a drain channel that branches from the sub supply circuit upstream of the point where the main supply circuit and the sub supply circuit merge and is in communication with a hydraulic tank.

According to this aspect, the amount of pressurized oil from the sub supply circuit that merges with the main supply circuit can be adjusted by adjusting the amount of pressurized oil that flows out into the drain channel. Thus, it is possible to provide a hydraulic system for a work vehicle that allows, through a simple configuration, the flow amount of the pressurized oil to be appropriately set for the attachment with which the work vehicle is provided.

A third characteristic aspect of the invention is that the flow amount of the drain channel can be adjusted by manually screwing the adjustment valve forward and backward.

According to this aspect, the flow amount of pressurized oil can be adjusted simply by manually screwing the adjustment valve forward and backward. Thus, it is possible to provide a hydraulic system for a work vehicle that allows, through a simple configuration, the flow amount of pressurized oil to be appropriately set for the attachment with which the work vehicle is provided.

A fourth characteristic aspect of the invention is that the main supply circuit is provided with a control valve;

the control valve blocks the supply of pressurized oil from the main pump to the service actuator when the travel motor is driven at full power;

the sub supply circuit is provided with a switch valve; and the switch valve links the sub supply circuit and the drain channel when the travel motor is not being driven, and blocks the drain channel when both the travel motor and the service actuator are driven.

According to this aspect, when driving the travel motor at full power, at which time it is necessary to supply a large amount of pressurized oil to the travel motor, the supply of pressurized oil from the main pump to the service actuator is blocked and the pressurized oil from the sub pump is supplied to the service actuator. On the other hand, at times other than when the travel motor is driven at full power, during which it is not necessary to supply a large amount of pressurized oil to the travel motor, the pressurized oil from the main pump is supplied to the service actuator. Further, by adjusting the flow amount of pressurized oil from the sub pump that is combined with the pressurized oil that is supplied by the main pump to the service actuator, the amount of pressurized oil that is supplied to the service actuator is adjusted.

Consequently, pressurized oil can be reliably supplied to the travel motor when the work vehicle is moving. When the work vehicle is not moving, the flow amount of the pressurized oil can be suitably set according to the attachment.

DETAILED DESCRIPTION OF THE PREFERRED EMBODIMENTS

Hereinafter, embodiments of the invention are described in specific detail in reference to FIGS. 1 through 9.

Figure 8:
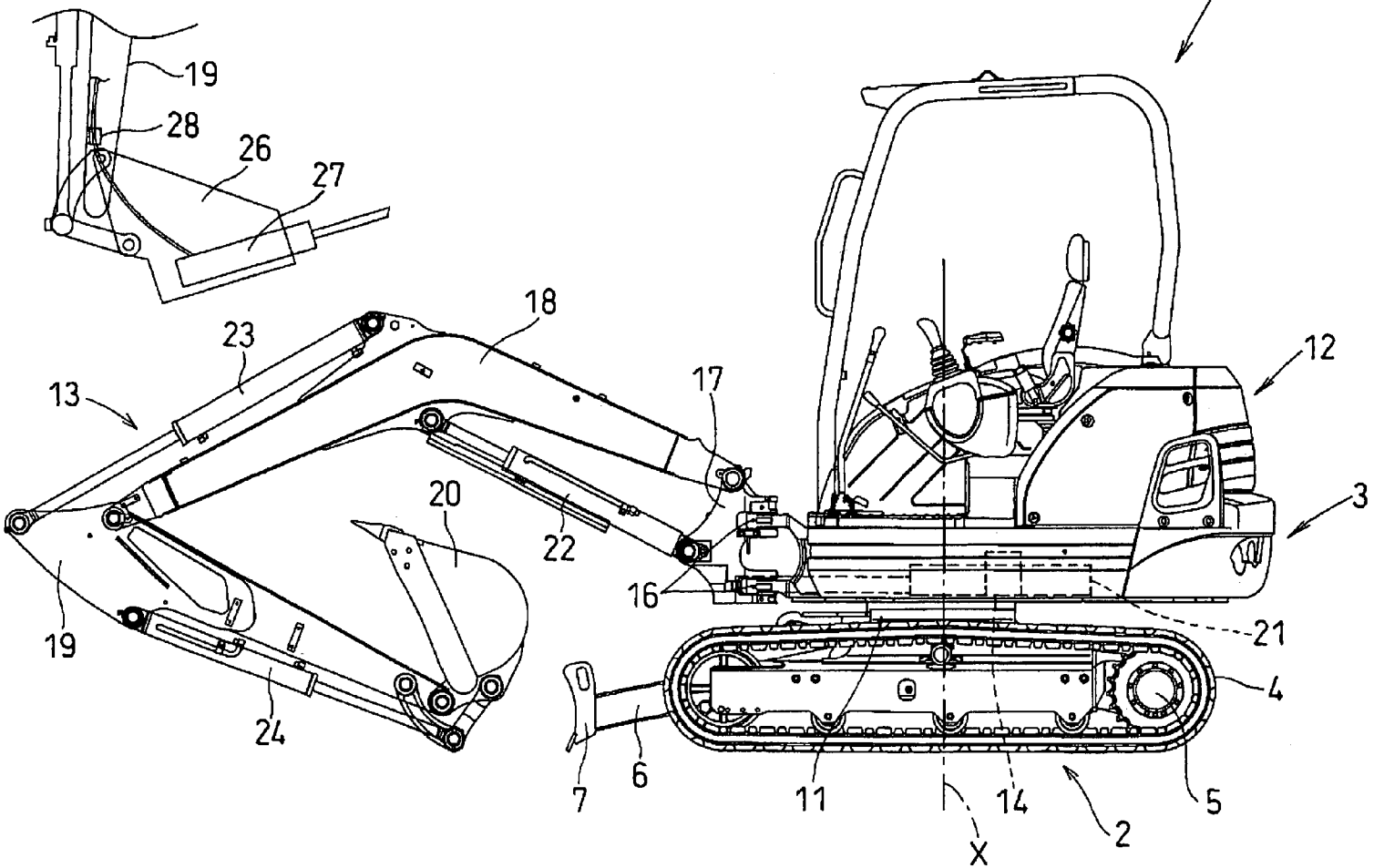
FIG. 8 is a left side view of the backhoe.
Figure 9:
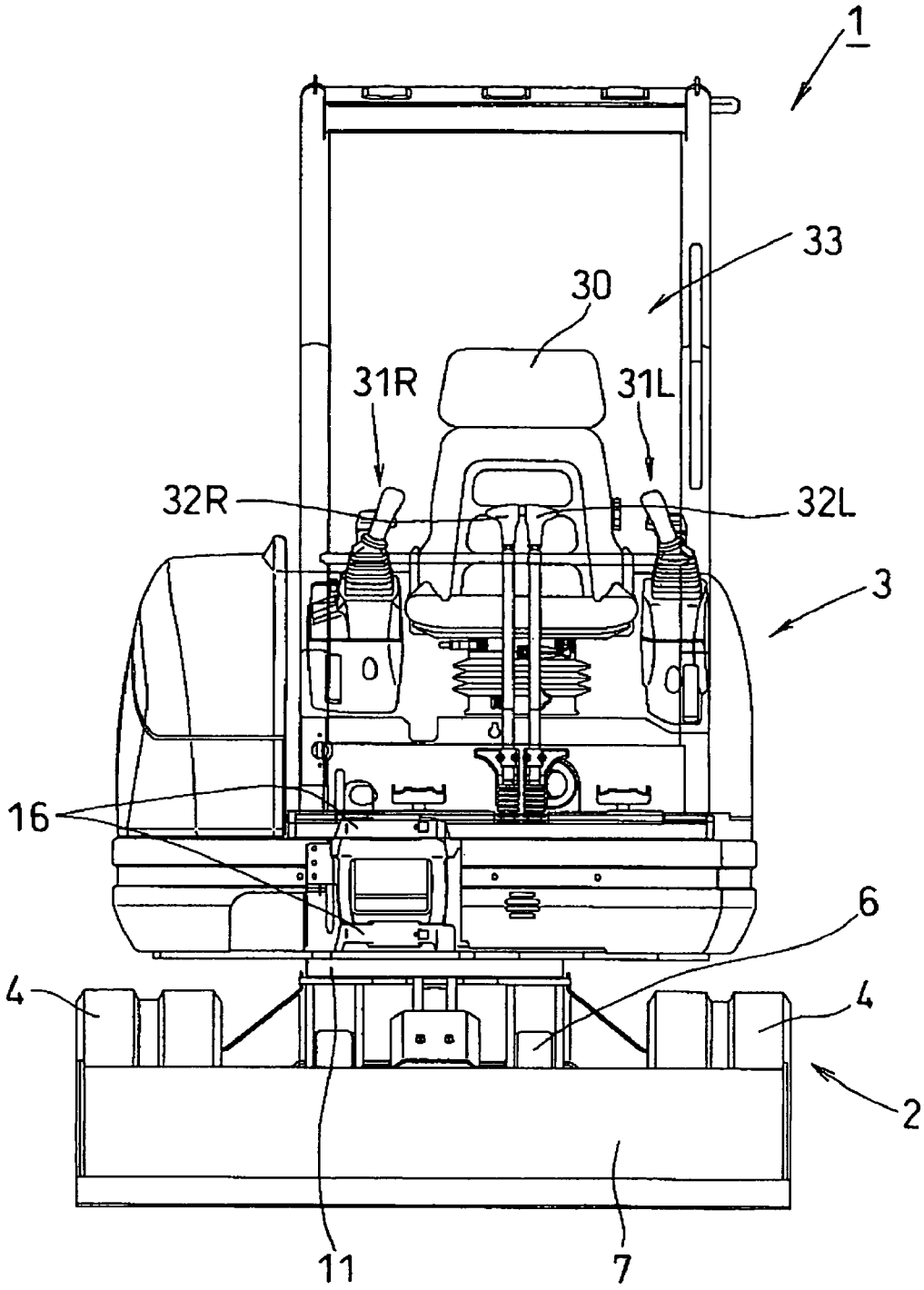
FIG. 9 is a front view of the travel device and the swivel base of a backhoe.

As shown in FIGS. 8 and 9, a backhoe 1 of this embodiment is provided with a lower travel device 2 and an upper revolving superstructure 3.

The travel device 2 is provided with a pair of left and right travel members, each provided with a rubber track 4 and a travel motor 5 for driving the rubber track 4. A crawler-type travel device is employed in this embodiment.

A dozer 7 that can be operated due to a dozer cylinder 6 is disposed in front of the travel devices 2.

The revolving superstructure 3 is made of a swivel base 12 that is supported above the travel devices 2 via swivel bearings 11 in such a manner that it can rotate about a vertical pivot axis X, and a work vehicle (in this embodiment, a digging device) 13 that is provided in front of the swivel base 12. In the swivel base 12 is disposed a hydraulic swivel motor 14 that rotates the swivel base about the pivot axis X together with the work vehicle 13.

The work vehicle 13 is detachably attached to the swivel base 12 via a support bracket 16 that is disposed in a front portion of the swivel base 12. The work vehicle 13 is furnished with a swing bracket 17 that is supported by the support bracket 16 in such a manner that it can swing left and right about a vertical axis, a boom 18 that is supported on the swing bracket 17 in such a manner that its base side can swing about an axis in the left-right direction, an arm 19 that is supported on the front end side of the boom 18 in such a manner that it can swing about an axis in the left-right direction, and a bucket 20 that is supported on the front end side of the arm 19 in such a manner that it can perform scooping and dumping actions.

The swing bracket 17 is swung due to the back and forth motion of a piston rod in a swing cylinder 21 that is provided in the swivel base 12. The boom 18 is swung due to the back and forth motion of a piston rod in a boom cylinder 22 that is interposed between the boom 18 and the swing bracket 17. The arm 19 is swung due to the back and forth motion of a piston rod in an arm cylinder 23 that is interposed between the arm 19 and the boom 18. The bucket 20 performs a scooping action and a dumping action due to the back and forth motion of a piston rod in a bucket cylinder 24 that is interposed between the bucket 20 and the arm 19.

It should be noted that the dozer cylinder 6, the swing cylinder 21, the boom cylinder 22, the arm cylinder 23, and the bucket cylinder 24 are each made of a hydraulic cylinder-type hydraulic actuator. The travel motor 5 and the swivel motor 14 are each made of a piston motor-type hydraulic actuator.

The bucket 20 can be removed from the arm 19, and in place of the bucket 20 it is possible to attach an attachment 26 such as a breaker, as shown in FIG. 8, to the fore end of the arm 19. The attachment 26 includes a service actuator 27 for driving the attachment 26. To supply pressurized oil to the service actuator 27, a service port 28 that serves as a pressurized oil port is disposed on the front end of the arm 19.

It should be noted that in this embodiment, a breaker is used as the hydraulic attachment 26, but it is also possible to attach many other types of hydraulic attachments, such as augers or cutters, that have different oil demands for their service actuator, to the fore end of the arm 19.

A driver's seat 30 is disposed on an upper portion of the swivel base 12, and the driver's seat 30, together with a pair of steering boxes 31L and 31R that are disposed on either side of the driver's seat and a pair of left and right travel levers 32L and 32R that are disposed in front of the driver's seat 30, constitute a drive operation device 33.

Figure 1:
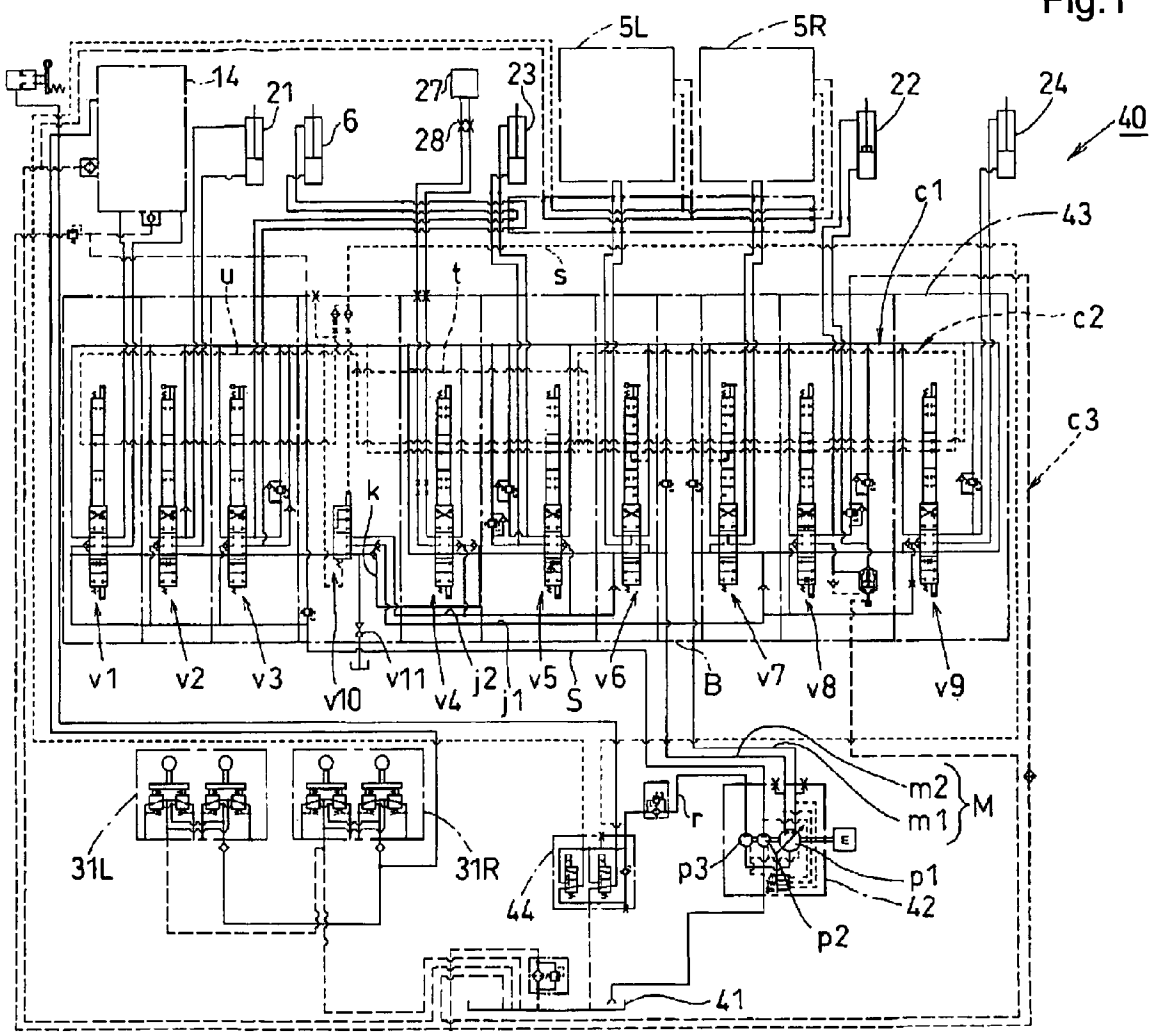
FIG. 1 is a circuit diagram of the hydraulic system 40 according to the invention.

FIG. 1 illustrates how the backhoe 1 of this embodiment is provided with a hydraulic system 40 for supplying pressurized oil to the above plurality of hydraulic actuators (in this embodiment, there are nine). The hydraulic system 40 is furnished with the above nine hydraulic actuators 5L, 5R, 6, 14, 21, 22, 23, 24 and 27, a tank 41 for holding pressurized oil to be supplied to these hydraulic actuators, a hydraulic pump unit 42 for delivering, under pressure, the pressurized oil in the tank 41 toward the hydraulic actuators, and a valve unit 43 that is disposed between the hydraulic actuators and the hydraulic pump unit 42 and that controls the hydraulic actuators.

The hydraulic system 40 also is furnished with two series of supply circuits, those being a hydraulic oil supply circuit cl for supplying the pressurized oil from the hydraulic pump unit 42 to the various actuators via the valve unit 43, and a pilot control circuit c2 for switching the hydraulic oil supply circuit c1 according to the operation of the various hydraulic actuators. The hydraulic oil supply circuit c1 and the pilot control circuit c2 are in communication with a drain circuit c3 that drains the return oil toward the tank 41.

It should be noted that in this embodiment, for the sake of convenience, in FIGS. 1 through 4 the circuit shown by the solid line is the hydraulic oil supply circuit c1, the circuit shown by the short dashed line is the pilot control circuit c2, and the circuit shown by the long dashed line is the drain circuit c3.

The valve unit 43 is furnished with a swivel control valve v1 for controlling the swivel motor 14, a swing control valve v2 for controlling the swing cylinder 21, a dozer control valve v3 for controlling the dozer cylinder 6, a SP (service port) control valve v4 for controlling the service actuator 27, an arm control valve v5 for controlling the arm cylinder 23, a left side travel control valve v6 for controlling the left side travel motor 5L, a right side travel control valve v7 for controlling the right side travel motor 5R, a boom control valve v8 for controlling the boom cylinder 22, and a bucket control valve v9 for controlling the bucket cylinder 24.

Figure 3:
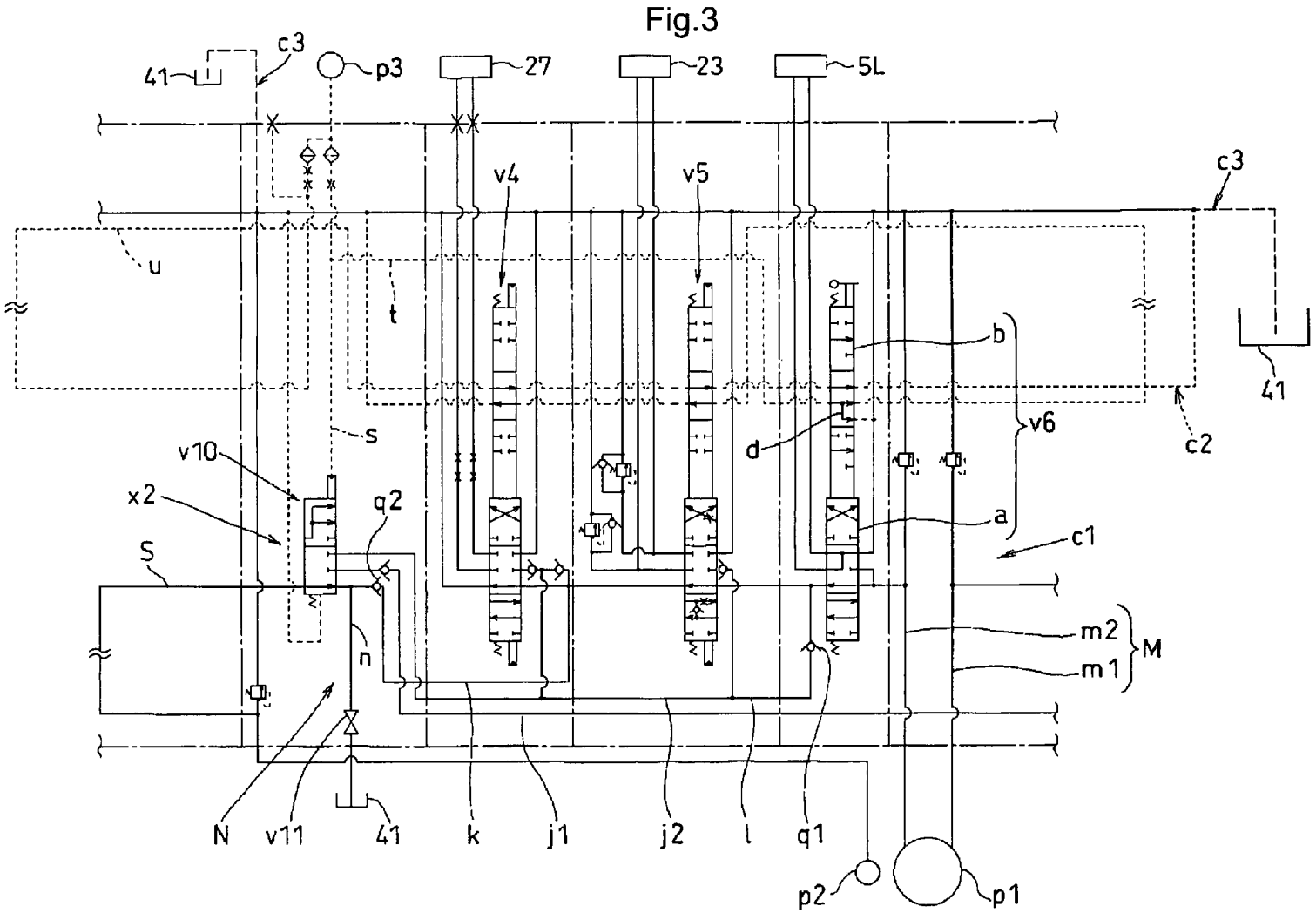
FIG. 3 is a circuit diagram showing important parts of the hydraulic system 40.

As illustratively shown by the left travel control valve in FIG. 3, the control valves v1 through v9 are each constituted by a direct-acting spool-type switch valve, and are provided with a hydraulic oil switch portion a for switching the hydraulic oil supply circuit c1 and a pilot pressure switch portion b for switching the pilot control circuit c2.

The hydraulic oil switch portion a is made of a 6-port 3-position switch valve, and can be switched between a first pressurized oil supply position for supplying pressurized oil in such a manner that the piston rod of the hydraulic actuator is actuated in one direction, an intermediate position that allows pressured oil to pass through without going through the hydraulic actuator, and a second pressurized oil supply position for supplying pressurized oil in such a manner that the piston rod of the hydraulic actuator is actuated in the other direction.

As shown in FIG. 1, of the above control valves, the pilot pressure switch portions b of the swivel control valve v1, the swing control valve v2, and the dozer control valve v3 are made of a 2-port 3-position switch valve, and can be switched between a pair of blocking positions for blocking the pilot control circuit c2, and an intermediate position that allows the pressurized oil in the pilot control circuit c2 to pass.

As illustrated by the SP control valve v4 in FIG. 3, the pilot pressure switch portions b of the SP control valve v4, the arm control valve v5, the boom control valve v8, and the bucket control valve v9 are made of a 4-port 3-position switch valve, and can be switched between a pair of blocking positions for blocking the pilot control circuit c2, and an intermediate position that allows the pressurized oil in the pilot control circuit c2 to pass.

As illustrated by the left side travel control valve v6 in FIG. 3, the pilot pressure switch portions b of the left side travel control valve v6 and the right side travel control valve v7 are made of a 5-port 3-position switch valve, and can be switched between a pair of blocking positions for blocking the pilot control circuit c2, and an intermediate position that allows the pressurized oil in the pilot control circuit c2 to pass, and the oil channel that becomes the intermediate position has a branch oil channel d that branches at an intermediate portion thereof and is connected to the drain circuit c3.

It should be noted that the hydraulic oil switch portion a and the pilot pressure switch portion b of the control valves v1 through v9 operate as a single unit, and if the control valves v1 to v9 have not been activated, then the hydraulic oil switch portion a and the pilot pressure switch portion b both are set to the intermediate position, if the control valves v1 to v9 are actuated in one direction from the intermediate position, then the hydraulic oil switch portion a is set to the first pressurized oil supply position and the pilot pressure switch portion b is set to one blocking position, and if the control valves v1 to v9 are actuated in the other direction from the intermediate position, then the hydraulic oil switch portion a is set to the second pressurized oil supply position and the pilot pressure switch portion b is set to the other blocking position.

It should be noted that the pilot pressure switch portions b of the control valves v1 to v5, v8, and v9 are designed so that actuating them even a small amount from the intermediate position will set them to one of the blocking positions, and the hydraulic oil switch portions a are designed so that they supply to the hydraulic actuators an amount of pressurized oil that is proportional to the amount by which the control valves v1 to v5, v8, and v9 have been actuated.

The pilot pressure switch portions b of the travel control valves v6 and v7 are designed so that they are set to a blocking position when the respective control valve has been set to the first or the second hydraulic oil supply position (when the travel motor is driven full power).

A channel switch valve v10 for switching the route of the pressurized oil is interposed between the dozer control valve v3 and the SP control valve v4, and an inlet block B for introducing pressurized oil is interposed between the left side travel control valve v6 and the right side travel control valve v7.

The channel switch valve v10 is formed as a spring offset pilot-type 4-port 2-position switch valve one end of which is connected to the pilot control circuit c2, and can be switched between an actuation position x1 in which it branches the hydraulic oil supply circuit c1 and an intermediate position x2 in which it does not branch the hydraulic oil supply circuit c1.

Here, the swivel control valve v1 and the arm control valve v5 can be operated by levers that are disposed in the left-side steering box 31L shown in FIG. 9, and the boom control valve v8 and the bucket control valve v9 can be operated by levers that are disposed in the right-side steering box 31R.

The left side travel control valve v6 can be operated by the left side travel lever 32L, and the right side travel control valve v7 can be operated by the right side travel lever 32R.

The swing control valve v2 can be operated by a swing pedal, the dozer control valve v3 can be operated by a dozer lever that is disposed to the side of the driver's seat 30, and the SP control valve v4 can be operated by a SP switch.

As shown in FIG. 1, the hydraulic pump unit 42 is furnished with these hydraulic pumps that are driven in connection with the driving of the engine that is installed in the swivel base 12, and in this embodiment it is furnished, with a main hydraulic pump p1, a sub hydraulic pump p2, and a pilot pump p3.

The main hydraulic pump p1 is a variable capacity hydraulic pump that is an equal flow amount double pump that yields an equal ejection amount from two separate ejection ports. The sub hydraulic pump p2 and the pilot pump p3 are fixed capacity gear pumps, for example.

The hydraulic oil supply circuit c1 is provided with a main supply circuit M that supplies pressurized oil from the main hydraulic pump p1 to the bucket control valve v9 through the SP control valve v4, and a sub supply circuit S that supplies pressurized oil from the sub hydraulic pump p2 to the dozer control valve v3 through the swivel control valve v1, and the main supply circuit M is provided with two systems, these being a first supply circuit m1 that supplies pressurized oil that has been ejected from one ejection port to the right side travel motor 5R, and a second supply circuit m2 that supplies pressurized oil that has been ejected from the other ejection port to the left side travel motor 5L.

The first supply circuit ml supplies the pressurized oil that has been delivered under pressure from the main hydraulic pump p1 to the inlet block B, next delivers this to the right side travel control valve v7, and then drains the pressurized oil to the drain circuit c3 after passing it through the boom control valve v8 and the bucket control valve v9.

The second supply circuit m2 supplies the pressurized oil that has been delivered under pressure from the main pump p1 to the inlet block B, next delivers this to the left side travel control valve v6, and then drains the pressurized oil to the drain circuit c3 after passing it through the arm control valve v5 and the SP control valve v4.

The sub supply circuit S supplies the pressurized oil that has been supplied from the sub hydraulic pump p2 to the swivel control valve v1, the swing control valve v2, and the dozer control valve v3, and is designed so that the pressurized oil does not flow into the channel switch valve v10 when these control valves v1 through v3 are not to be actuated. The sub supply circuit S is connected to the main supply circuit M through the channel switch valve v10.

As shown in FIG. 3, on the downstream side of the channel switch valve v10 (between the channel switch valve v10 and the second supply circuit m2) are disposed a first connecting oil channel j1 for combining the pressurized oil from the sub hydraulic pump p2 with the pressurized oil within the first supply circuit m1 of the main supply circuit M when the channel switch valve v10 has been switched to the actuation position x1, a second connecting oil channel j2 for combining the pressurized oil from the sub hydraulic pump p2 with the pressurized oil within the second supply circuit m2, and a third connecting oil channel k for combining the pressurized oil from the sub hydraulic pump p2 with the pressurized oil within the second supply circuit m2 when the channel switch valve v10 is in the intermediate position x2.

As shown in FIG. 1, one end portion of the first connecting oil channel j1 is connected to the channel switch valve v10 and its other end portion is connected to the first supply circuit m1 at a position that is between the right side travel control valve v7 and the boom control valve v8.

As shown in FIG. 3, one end portion of the second connecting oil channel j2 is connected to the channel switch valve v10 and its other end portion is connected to the second supply circuit m2 at a position that is between the left side travel control valve v6 and the arm control valve v5. An intermediate portion of the second connecting oil channel j2 branches and is connected to an area between the arm control valve v5 and the SP control valve v4. A merging oil channel 1 for connecting a portion of the first supply circuit m1 on the downstream side of the left travel control valve v6 and the second connecting oil channel j2 is connected to the second connecting oil route j2, and the merging oil channel 1 is provided with a check valve q1 for preventing the influx of pressurized oil from the second connecting oil channel j2.

One end portion of the third connecting oil channel k is connected to the channel switch valve v10 and its other end portion is connected to a position of the second supply circuit m2 that is between the arm control valve v5 and the SP control valve v4. A check valve q2 for preventing the influx of pressurized oil from the second supply circuit m2 is provided at an intermediate portion of the third connecting oil channel k. A drain oil channel N for draining pressurized oil from the sub hydraulic pump p2 into the tank 41 is connected to the upstream side of the check valve q2 and to the downstream side of the channel switch valve v10.

A stopcock v11 for blocking the flow of the pressurized oil that is drained from the sub hydraulic pump p2 into the tank 41 is disposed in the drain oil channel N, and by opening the stopcock v11, the pressurized oil that flows from the channel switch valve v10 into the third connecting oil channel k is drained into the tank 41. Closing the stopcock v11 causes the pressurized oil that has flowed from the channel switch valve v10 into the third connecting oil channel k to flow into the second supply circuit m2 without flowing into the drain oil channel N.

Figure 2:
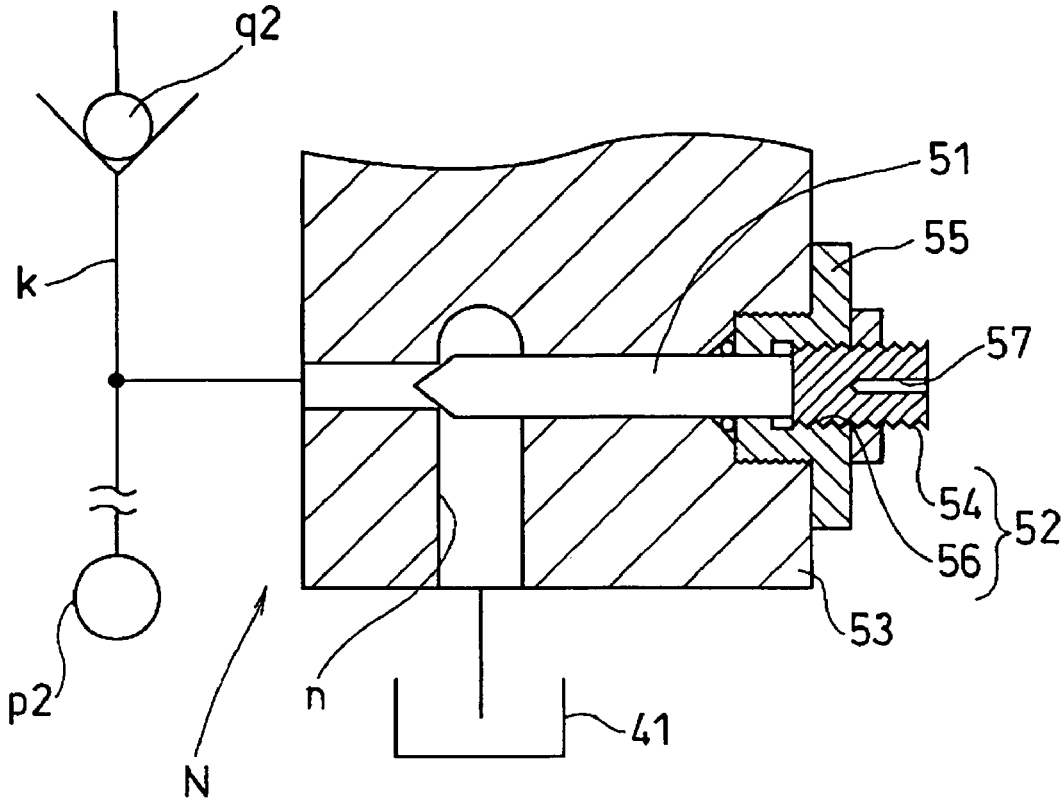
FIG. 2 is a circuit diagram of the drain oil channel N and a cross-sectional view of the stopcock area.

The stopcock v11, as shown in FIG. 2, is made of a rod-shaped valve member 51 that enters and closes off an oil channel n, which makes up a portion of the drain oil channel formed in the main valve unit 53 of the spool section provided with the channel switch valve v10.

One end portion of the valve member 51 is inserted into the oil channel n and its other end portion projects toward the outside of the main valve unit 53, and the valve member 51 is screwed into a plug 55, which is screwed into the main valve member 53, via a screw mechanism 52. The screw mechanism 52 is made of a male screw portion 54 that is formed in the base end portion of the valve member 51 and a female screw portion 56 that is formed in the plug 55.

In the other end portion of the valve member 51 is provided, over the valve member 51 axis, a fitting hole 57 into which rotating tools such as drivers, hexagonal wrenches, or rotating handles for rotating the valve member 51 are fitted. A rotating tool is fitted into the fitting hole, and by rotating the rotating tool, the valve member 51 is screwed forward or screwed rearward with respect to the oil channel n. By screwing the valve member 51 forward, the oil channel n is set to a blocked state in which its channel is blocked by the valve member 51, and by screwing the valve member 51 rearward, it is set to a communication state in which its channel is open.

It is also possible to locate the fore end portion of the valve member 51 to a position between the position for the blocked state and the position for the open state by operating the rotating tool, and by doing this it is possible to adjust the amount that the oil channel n is open and thus adjust the amount of pressurized oil that flows through the oil channel n and into the tank 41.

As shown in FIG. 1, the pilot control circuit c2 is provided with a pilot pressure supply oil channel r for supplying pressurized oil from the pilot pump p3 to a pilot pressure adjustment unit 44 made of an unload valve and a two-speed switch valve, and from an intermediate portion of the pilot pressure supply oil channel r is branched a first signal oil channel s that extends up to the spool section of the channel switch valve v10 of the valve unit 43. The front end portion of the first signal oil channel s is connected to the pilot route of the channel switch valve v10, and as a result the channel switch valve v10 is switched from the intermediate position x2 to the actuation position x1 due to the rise in pressure in the first signal oil channel s. A second signal oil channel t and a third signal oil channel u are disposed branching from an intermediate portion of the first signal oil channel s.

The second signal oil channel t is connected to the drain circuit c3 passing through the pilot pressure switch portions b of the left side travel control valve v6→the right side travel control valve v7→the boom control valve v8→the bucket control valve v9→the arm control valve v5→and the SP control valve v4.

The third signal oil channel u is connected to the drain circuit c3 passing through the pilot pressure switch portions b of the dozer control valve v3→the swing control valve v2→and the swivel control valve v1, and then passing through the pilot pressure switch portions b of the SP control valve v4→the arm control valve v5→the left side travel control valve v6→the right side travel control valve v7→the boom control valve v8→and the bucket control valve v9.

Figure 4:
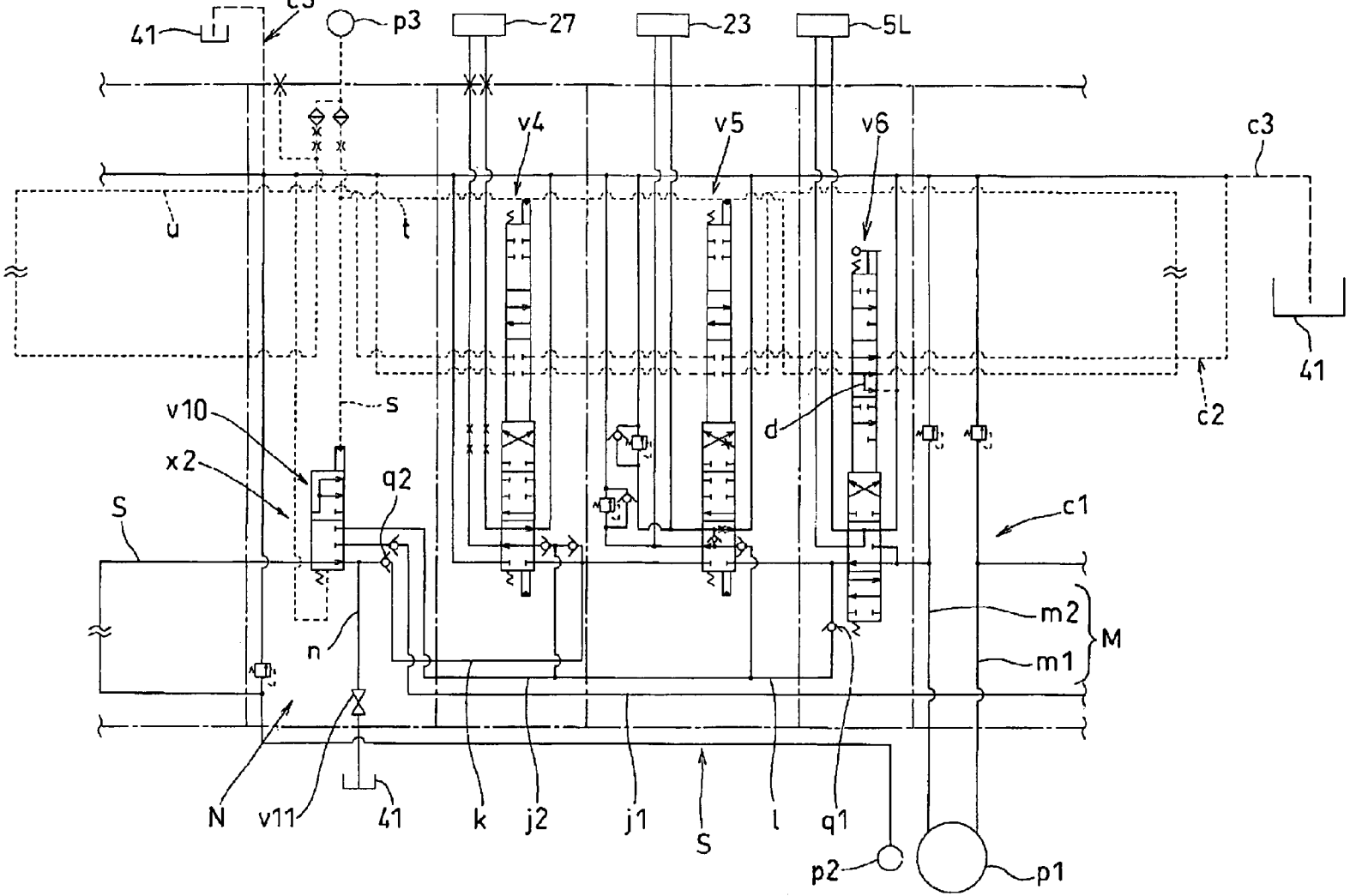
FIG. 4 is a circuit diagram showing a state in which the SP control valve and the arm control valve have been actuated.
Figure 5:
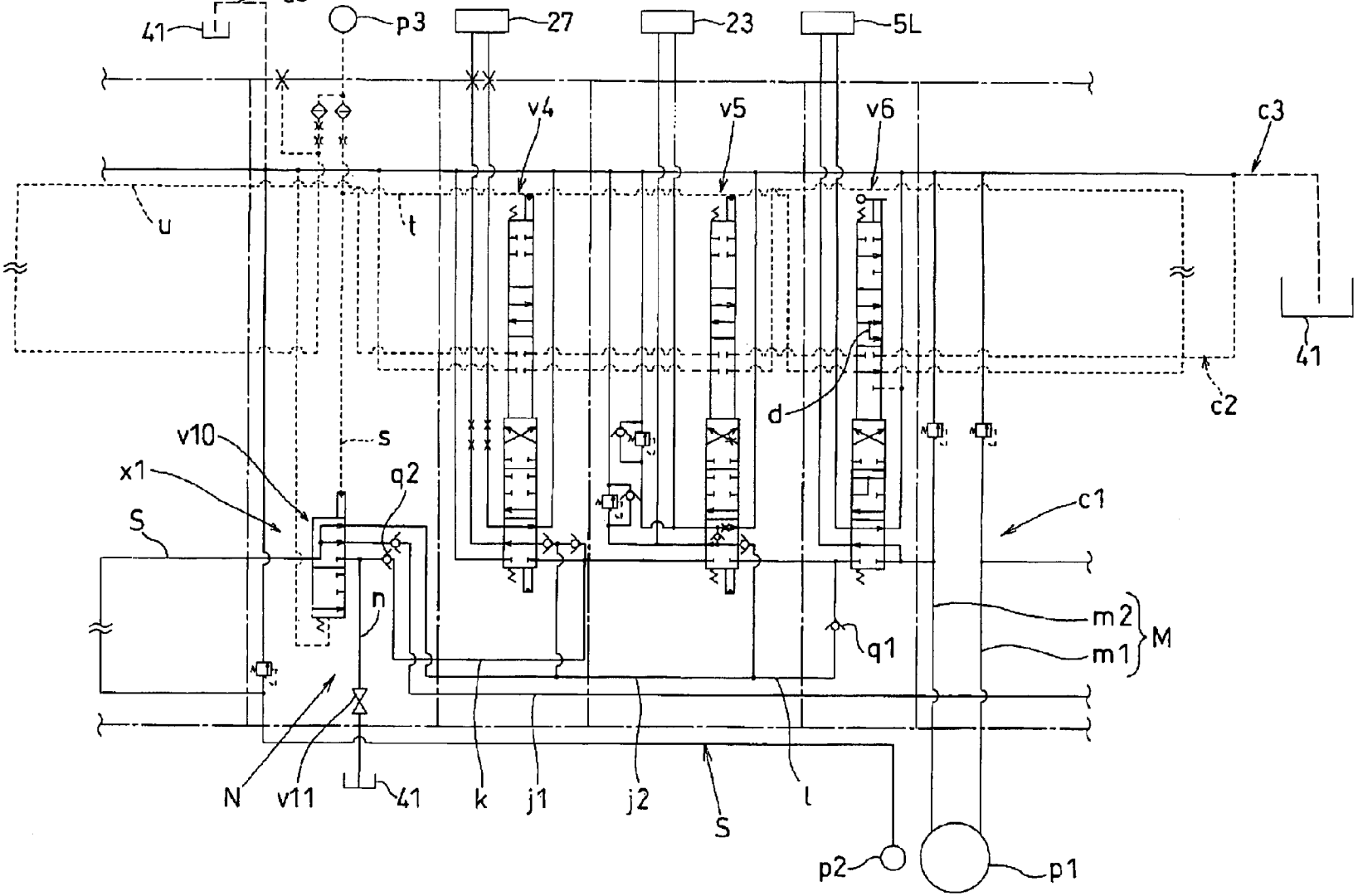
FIG. 5 is a circuit diagram showing a state in which the SP control valve, the arm control valve, and the travel control valve have been actuated.

The present embodiment has the above configuration, and next, the operation of the hydraulic system 40 is described using FIGS. 3 to 5, focusing on the second supply circuit m2 of the main supply circuit M and the sub supply circuit S.

As shown in FIG. 3, if the left side travel control valve v6 is not to be actuated, then the left side travel control valve v6 is held in the intermediate position x2. Thus, the pressurized oil from the main hydraulic pump p1 passes through the left side travel control valve v6 and then is supplied to the arm cylinder 23 by way of the arm control valve v5 and is supplied to the service actuator 27 by way of the SP control valve v4.

Here the left side travel control valve v6 has been set to the intermediate position, and thus the pilot oil that flows into the second signal oil channel t is drained into the drain circuit c3 via the branch oil channel c of the intermediate position of the left side travel control valve v6. Thus, the pressure does not rise in the first signal oil channel s even if any of the arm control valve v5, the boom control valve v8, and the bucket control valve v9 are actuated from the swivel control valve v1 in this state, and thus the channel switch valve v10 remains in the intermediate position x2. For this reason, the pressurized oil from the sub hydraulic pump p2 passes through the dozer control valve v3 from the swivel control valve v1 and then flows into the third connecting oil channel k via the channel switch valve v10.

At this time, if the valve member 51, which serves as the stopcock v11 for the drain oil channel N, has been screwed forward to set the oil channel n to the closed state, then the pressurized oil from the sub hydraulic pump p2 that has flowed into the third connecting oil channel k flows into the second supply circuit m2 without flowing into the drain oil channel N and merges with the pressurized oil from the main hydraulic pump p1 that has been supplied to the second supply circuit m2. The combined pressurized oil from these two pumps then is supplied to the service actuator 27 through the SP control valve v4, and is supplied to the arm cylinder 23 through the arm control valve v5.

On the other hand, if the valve member 51 is unscrewed in the rearward direction to set the oil channel n to the open state, then the pressurized oil from the sub hydraulic pump p2 that has flowed into the third connecting oil channel k flows into the drain oil channel N and is drained into the tank 41 over the oil channel n. Thus, the SP control valve v4 and the arm control valve v5 are supplied only with the pressurized oil from the main hydraulic pump p1 through the second supply circuit m2, and are not supplied with pressurized oil from the sub hydraulic pump p2.

If the front end of the valve member 51 is positioned at an intermediate portion of the oil channel n to set the oil channel n to a half open state, then an amount of pressurized oil that corresponds to the extent to which the oil channel n is open is drained into the tank 41 through the oil channel n, and the remaining pressurized oil flows into the second supply circuit m2 through the third connecting oil channel k and merges with the pressurized oil from the main hydraulic pump p1 as described above.

As shown in FIG. 4, when the arm control valve v5 and the SP control valve v4 are switched to the first pressurized oil supply position while keeping the left side travel control valve v6 in the intermediate position, the pressurized oil from the main hydraulic pump p1 flows into the merging oil channel l after passing through the left side travel control valve v6 and is supplied to the arm control valve v5 and the SP control valve v4 via the third connecting oil channel k. Here, as described above, screwing the valve member 51 of the drain oil channel N forward and backward allows whether or not to allow the pressurized oil from the sub hydraulic pump p2 to flow into the second supply route m2 to be selected and allows the amount of that flow to be adjusted.

As shown in FIG. 5, in a case where the left travel control valve v6 has been switched to the first pressurized oil supply position (or the second pressurized oil supply position) to drive the travel motor 5 at full power, the pressurized oil that is supplied from the main hydraulic pump p1 to the second supply circuit m2 is drained into the drain circuit c3 after passing through the left travel control valve v6 and the left side travel motor 5L.

The pilot pressure switch portion b of the left travel control valve v6 is set to the blocking position at this time, and this opens the second signal oil channel t and blocks the third signal oil channel u as well as the branching oil channel c. In this state, if the SP control valve v4 or the arm control valve v5 is switched to either of the pressurized oil supply positions (in this embodiment, the first pressurized oil supply position), then the second signal oil channel t is blocked by that switched control valve, and this in turn causes the pressure to rise in the first signal oil channel s and the pressure causes the channel switch valve v10 to move from the intermediate position x2 to the actuation position x1. The pressurized oil from the sub hydraulic pump p2 is supplied to the first connecting oil channel j1 and the second connecting oil channel j2 through the channel switch valve v10, which has been switched to the actuation position x1.

The pressurized oil that has flowed into the first connecting oil channel j1 then flows into the first supply circuit m1 and imparts a motive force on the boom cylinder 22 and the bucket cylinder 24. The pressurized oil that has flowed into the second connecting oil channel j2 flows into the second supply circuit m2 and imparts a motive force on the service actuator 27 and the arm cylinder 23.

In this embodiment, screwing in the valve member 51, which serves as the stopcock v11 of the drain oil channel N, to set the oil channel n to the closed state when the travel control valves v6 and v7 have been set to the intermediate position causes the pressurized oil from the sub hydraulic pump p2 to flow into the second supply circuit m2 through the third connecting oil channel k and merge with the pressurized oil from the main hydraulic pump p1 that is being supplied to the second supply circuit m2.

On the other hand, unscrewing the valve member 51, which serves as the stopcock v11 of the drain oil channel N, when the travel control valves v6 and v7 have been set to the intermediate position in order to set the oil channel n to the open state causes the pressurized oil from the sub hydraulic pump p2 to drain into the tank 41 through the drain oil channel N so that the pressurized oil does not flow into the second supply circuit m2. At this time, the route over which the pressurized oil from the sub hydraulic pump p2 is shortened and thus there is a drop in pressure damage due to the pressurized oil and heat loss due to internal friction.

Setting the travel control valves v6 and v7 to the intermediate position and adjusting the valve member 51, which serves as the stopcock v11 of the drain oil channel N to open the oil channel n to a degree that is between the closed state and the open state allows some of the pressurized oil from the sub hydraulic pump p2 to flow into the second supply circuit m2 through the third connecting oil channel k and merge with the pressurized oil from the main hydraulic pump p1, and the remaining pressurized oil drains into the tank 41 through the drain oil channel N.

In other words, the amount of oil that passes through the oil channel n is controlled by actuating the valve member 51, and thus the amount of pressurized oil that is supplied to the service actuator 27 is adjusted in accordance with the type of the hydraulic actuator service actuator.

Consequently, regardless of which of a plurality of types of hydraulic attachments has been attached to the boom 19, it is possible to supply an amount of oil that corresponds to the service actuator of the hydraulic attachment to that service actuator, and it not necessary to change the valve unit 43 in accord with the hydraulic attachment that has been selectively attached.

To put it differently, the supply of pressurized oil from the main hydraulic pump p1 becomes insufficient for operation, and to overcome this insufficiency in supply, the valve member 51 serving as the stopcock v11 can be adjusted to supplement the insufficient amount of pressurized oil with pressurized oil from the sub hydraulic pump p2.

The valve member 51 for opening and closing the oil channel n is fitted into the main valve unit 53 via the screw mechanism 52 in such a manner that it can be screwed in and unscrewed from the main valve unit 53, and thus the degree to which the oil channel n is open can be adjusted through the extremely simple action of attaching a rotating tool to the valve member 51 and manually rotating that rotating tool.

Whether or not to allow the flow of pressurized oil from the sub hydraulic pump p2 into the second supply circuit m2 is determined by the simple configuration of whether or not the drain oil channel N is connected to the third connecting oil channel k, and thus the structure of the valve unit 43 is not complicated and thus by extension there is no worry of increased manufacturing costs.

As noted above, the SP control valve v4 of this embodiment is formed in such a manner that it can be actuated by a SP switch (not shown in the drawings). The SP switch can be switched between a pair of input positions and the intermediate position x2, and the SP control valve v4 is set to the first pressurized oil supply position by switching the SP switch to one of the input positions and the SP control valve v4 is set to the second pressurized oil supply position by switching the SP switch to the other input position. The SP control valve v4 is set to the intermediate position by setting the SP switch to the intermediate position.

Figure 6:
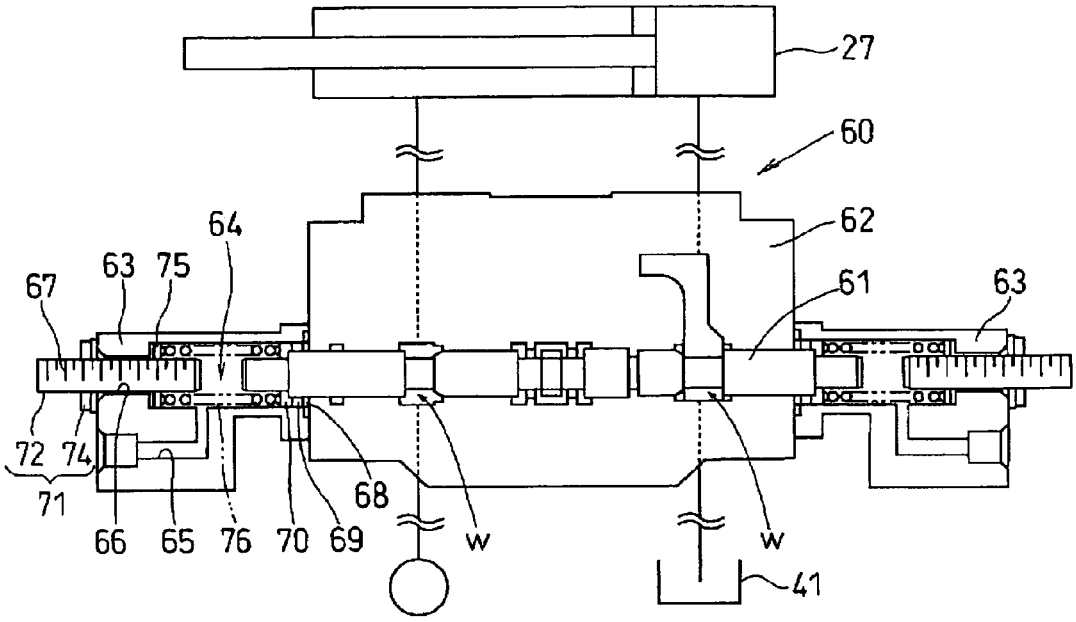
FIG. 6 is a cross-sectional view of the spool section 60 in the SP control valve.

As shown in FIG. 6, the spool section 60, which includes the SP control valve v4, is furnished with a rod-shaped spool 61, a main valve unit 62 that has an insertion path through which the spool 61 is movably inserted in the axial direction, and a pair of caps 63 that are attached to the ends of the main valve unit 62 and that cover the end portions of the spool 61. The spool 61 is inserted through the main valve unit 62 via ring-shaped seals.

The caps 63 are provided with a depression that serves as an accommodation room 64 for accommodating one end of the spool 61 inserted through the main valve unit 62, and to the accommodation room 64 is connected a spool control oil channel 65 that serves as a flow route for pilot oil for controlling the action of the spool 61. The caps 63 also are provided with a cylindrical opening portion 66 that is coaxial with the spool 61, and in the opening portion 66 is disposed a rod-shaped stopper rod 67 whose end portion is in opposition to the end portion of the spool 61. The space between the end portion of the stopper rod 67 and the spool 61 becomes the stroke of the spool 61.

A seal member such as an O-ring is disposed between the stopper rod 67 and the cap 63.

A cap seal that is an O-ring or the like is disposed between the main valve unit 62 and the cap 63, and a spool seal 68 along the outer circumferential surface of the spool 61 is disposed on the inner diameter side of the seal member. The spool seal 68 is pushed toward the wall surface of the main valve unit 62 by a wiper 69 that is disposed along the outer circumferential surface of the spool 61, and a flange 70 along the outer circumferential surface of the spool 61 is fitted into the spool 61 at a position that is closer to the tip of the spool 61 than the wiper 69.

A screw mechanism 71 for screwing the stopper rod 67 into the cap 63 is provided between the stopper rod 67 and the cap 63, and the screw mechanism 71 is made of a male screw portion 72 that is formed in the stopper rod 67 and a female screw portion 74 that is formed in the bearing unit disposed on the outer wall surface of the cap 63. A flange 75 along the outer circumferential surface of the stopper rod 67 is attached to the accommodation room side end portion of the stopper rod 67.

A spring 76 that stretches and contracts in the axial direction of the spool 61 is disposed in the accommodation room 64, and the spring 76 is held between the flange 75 of the stopper rod 67 and the flange 70 of the spool 61.

It should be noted that the other cap 63 and the other end of the spool 61 that is covered by the cap 63 have the same configuration as described above, and thus will not be described here.

In the spool section 60 having the above configuration, if a pilot pressure is supplied to the accommodation room 64 side of one of the caps 63, then the spool 61 moves toward the other cap 63 in the axial direction by the stroke amount, and the spring 76 that is disposed in the other cap 63 is sandwiched by the pair of flanges 70 and 75 and compressed, building up an elastic return force. When the pilot pressure is drained from the accommodation room 64, the elastic return force of the spring 76 applies a pushing pressure against the end portion of the spool 61 within the other cap 63 and the flange 70 of the spool 61 that causes the spool 61 to return to its original intermediate position. The same applies for the case when pilot pressurized oil is supplied to the accommodation room 64 of the other cap 63.

With the spool section 60, screwing and unscrewing one or both of the stopper rods 67 increases and decreases the space between the end portion of the stopper rod 67 on its accommodation room side and the spool 61 end portion, and by doing this the stroke of the spool 61 is adjusted.

In other words, by screwing the stopper rod 67 forward to draw the accommodation room-side end portion of the stopper rod 67 closer to the end portion of the spool 61, which is in the intermediate position, the stroke of the spool 61 is shortened and this narrows the oil channel w for supplying actuation oil, which is formed by the spool 61 and the main valve unit 62, and thereby reduces the amount of pressurized oil that is supplied to the service actuator 27 through the oil channel w. As a result, the amount of pressurized oil that is supplied to the service actuator 27 per unit time is reduced, and this reduces the speed at which the service actuator 27 is actuated due to manipulation of the SP switch.

By unscrewing the stopper rod 67 to separate the accommodation room-side end portion of the stopper rod 67 from the end portion of the spool 61, which is in the intermediate position, the stroke of the spool 61 is lengthened and thus the oil channel w is widened more than when the stopper rod 67 has been brought near to the spool 61, and this increases the amount of pressurized oil that is supplied to the service actuator 27 through the oil channel w more than in the case described above.

As a result, the amount of pressurized oil that is supplied to the service actuator 27 per unit area is increased, and this speeds up the rate at which the service actuator 27 is activated due to manipulation of the SP switch.

Figure 7:
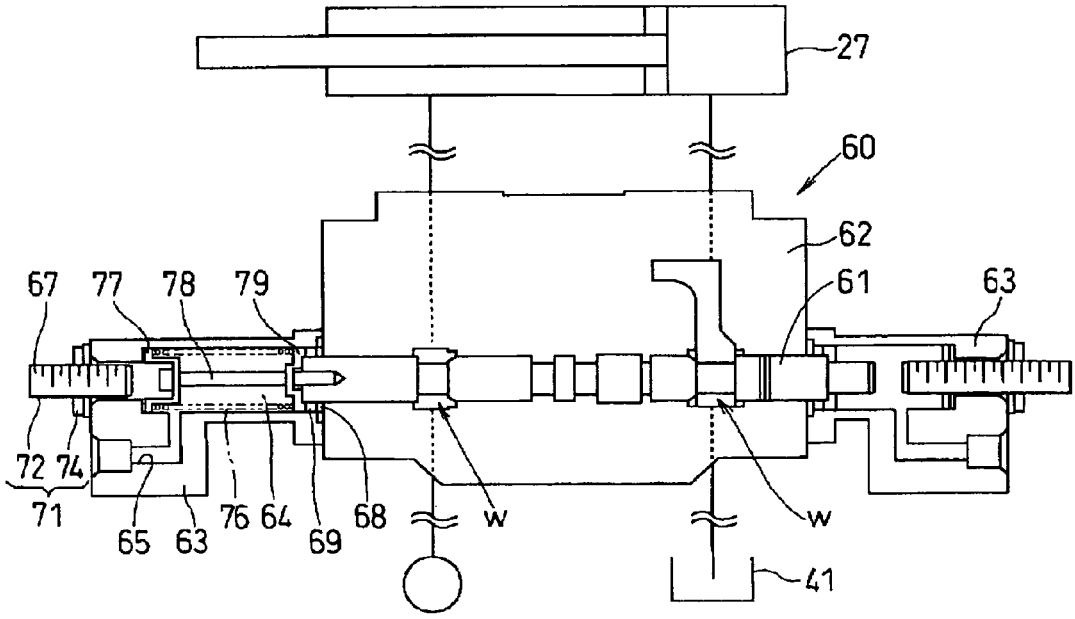
FIG. 7 is a cross-sectional view of the spool section 60 in another SP control valve.

In the spool section 60 shown in FIG. 7, a spool end 78 that is fitted to the outside of the flange member 77 at one end portion of the spool 61 is disposed on the axis of the spool 61, and the flange 79 abuts against the one end portion of the spool 61.

The spring 76 is sandwiched between the flange 79 and the flange member 77 of the spool end 78. If the pilot pressure is supplied to the one cap 63 where the spring 76 is disposed, then the spool end 78 and the flange member 77 are pushed by the pilot pressure, and as a result the spool 61 moves in the axial direction toward the other cap 63 by the stroke amount and the spring 76 contracts and builds up an elastic return force. When the pilot pressurized oil is drained from the accommodation room 64, the elastic return force of the spring 76 pushes the flange member 77 of the spool end 78 and causes the spool 61 to return to its original intermediate position.

On the other hand, if the pilot pressure is supplied to the other cap 63 in which the spring 76 is not disposed, then the end portion of the spool 61 is pushed by the pilot pressure, and this consequently moves the spool 61, by the stroke amount, in the axial direction toward the one cap 63, and along with this the spool end 78 and the flange 79 move as well. At this time, the flange member 77 is abutted against the wall surface of the accommodation room 64, and thus the flange member 77 does not move. Consequently, the spring 76 is contracted and stores an elastic return force. When the pilot pressurized oil is then drained from the accommodation room 64, the elastic return force of the spring 76 imparts a pushing pressure against the spool 61 and the flange 79 and thus returns the spool 61 to its original position.

In this embodiment, the space between the end portion of the stopper rod 67 on its accommodation room 64 side and the spool 61 end portion is adjusted by screwing and unscrewing one or both of the stopper rods 67 to adjust the stroke of the spool 61, and by extension adjust the amount of pressurized oil that is supplied to the service actuator 27 per unit time.

The foregoing presents a detailed description of the present embodiment, however, the invention is not limited to the foregoing embodiment. For example, the same effects as in the present embodiment are exhibited even when the pilot pressure can move the stopcock v11. Further, any or all of the control valves may be pilot actuated, or manually or electromagnetically actuated.

It is also possible to adopt a configuration in which the pilot oil channel switch portions b of the control valves v1 through v9, when actuated from the intermediate position even slightly, are set to either one of the blocking positions. Alternatively, it is also possible to adopt a configuration in which the pilot oil channel switch portions b of the control valves v1 through v9 are set to a blocking position when the control valves v1 to v9 have been set to the first or second pressurized oil supply positions.

What is claimed is:

1. A hydraulic system for a work vehicle, comprising:

a main hydraulic pump;

a main supply circuit through which pressurized oil from the main hydraulic pump flows;

a sub hydraulic pump; and a sub supply circuit through which pressurized oil from the sub hydraulic pump flows;

wherein the main supply circuit supplies pressurized oil to a hydraulic travel motor that drives a travel device, and a service actuator that is disposed in an attachment with which the work vehicle is detachably furnished, and the sub supply circuit merges with the main supply circuit and supplies pressurized oil to the service actuator; and wherein the hydraulic system for a work vehicle further comprises a flow amount adjustment valve that adjusts the flow amount of the pressurized oil from the sub supply circuit that merges with the main supply circuit, the flow amount adjustment valve being provided in a drain channel that branches from the sub supply circuit upstream of the point where the main supply circuit and the sub supply circuit merge and is in communication with a hydraulic tank; and wherein the sub supply circuit is provided with a switch valve that links the sub supply circuit and the drain channel when the travel motor is not being driven, and blocks the drain channel when both the travel motor and the service actuator are driven.

2. The hydraulic system for a work vehicle according to claim 1, wherein the flow amount of the drain channel can be adjusted by manually screwing the adjustment valve forward and backward.

3. The hydraulic system according to claim 1, wherein the main supply circuit is provided with a control valve; and wherein the control valve blocks the supply of pressurized oil from the main pump to the service actuator when the travel motor is driven at full power.

* * * * *